US005928470A

United States Patent [19]

Shannon

[11] Patent Number: 5,928,470

[45] Date of Patent: Jul. 27, 1999

[54] METHOD FOR FILLING AND COATING CELLULOSE FIBERS

[75] Inventor: Thomas Gerard Shannon, Neenah, Wis.

[73] Assignee: Kimberly-Clark Worldwide, Inc., Neenah, Wis.

[21] Appl. No.: 08/966,090

[22] Filed: Nov. 7, 1997

[51] Int. Cl.[6] ..... D21H 11/20

[52] U.S. Cl. ..... 162/9; 162/100; 162/146; 162/157.6; 162/181.1; 162/181.2; 162/181.3; 162/181.4; 162/181.5; 162/182; 162/183

[58] Field of Search ..... 162/9, 100, 181.1, 162/181.2, 181.3, 181.4, 181.5, 182, 183, 146, 157.6

[56] References Cited

U.S. PATENT DOCUMENTS

| | | | |
|---|---|---|---|
| 2,583,548 | 1/1952 | Craig | 106/204 |
| 3,029,181 | 4/1962 | Thomsen | 162/181 |
| 4,452,969 | 6/1984 | McCready | 528/279 |
| 4,452,970 | 6/1984 | Brunelle | 528/279 |
| 5,096,539 | 3/1992 | Allan | 162/9 |
| 5,122,230 | 6/1992 | Nakajima | 162/181.2 |
| 5,223,090 | 6/1993 | Klungness et al. | 162/181.2 |
| 5,275,699 | 1/1994 | Allan et al. | 162/181.2 |
| 5,453,479 | 9/1995 | Borman et al. | 528/279 |

*Primary Examiner*—Peter Chin
*Attorney, Agent, or Firm*—Gregory E. Croft

[57] ABSTRACT

Metal oxides or metal hydroxides, such as titanium dioxide, are incorporated into papermaking fibers by absorbing an organometallic compound into the fiber walls while the fibers are dry or slurried with a non-aqueous solvent and thereafter contacting the ester-containing fibers with water to precipitate the metal oxides or metal hydroxides. The resulting modified fibers can provide greater opacity and other improved properties to papers made from such fibers.

11 Claims, No Drawings

METHOD FOR FILLING AND COATING CELLULOSE FIBERS

BACKGROUND OF THE INVENTION

In the manufacture of various grades of paper, it is common to incorporate fillers and opacifiers into the paper in order to improve the optical properties of the paper. Increasing the opacity of the paper is particularly desirable for writing papers and tissue. In this regard, it is necessary to adequately retain the filler materials on the fibers in order to ensure that the filler materials remain with the fibers during the pulping and forming stages of the papermaking process. Commercially this is usually achieved by flocculating the filler with a cationic starch or similar coagulant and adding a cationic or anionic retention aid. Even with the use of such process aids, however, filler losses can be significant, especially in low basis weight products or high speed processes. Poor retention of fillers can cause plugging of papermaking felts, fouling of the white water system, and increased raw materials costs.

To this end, calcium carbonate and other suitable salts have been incorporated into the fiber walls and works reasonably well. However, although there are other metal compounds that provide significantly improved hiding power, suitable methods for incorporating such compounds into the fiber walls have not been developed. For example, titanium dioxide, when compared to calcium carbonate, has a higher refractive index and greater scattering power and is about ten times more efficient on a per pound basis. However, no suitable method has yet been devised to incorporate these other compounds into the cell walls of papermaking fibers.

Therefore a need exists to produce a pulp where a high refractive index pigment, such as titanium dioxide, can be incorporated into the fiber cell walls to produce fibers having a very high refractive index and having a very high retention of filler in high shear processes or products of low basis weight as well as good retention of physical properties.

SUMMARY OF THE INVENTION

It has now been discovered that metal oxides and metal hydroxides, including titanium dioxide, can be incorporated within the cell walls of papermaking fibers to serve as fillers or opacifiers for making various forms of paper from such modified fibers. these fibers are generally characterized by having increased strength and retention relative to conventionally filled products, improved retention over lumen loaded pulp and by having greater opacifying power relative to fibers modified by other methods which incorporate insoluble salts within the cell walls.

Hence in one aspect, the invention resides in a method of making metal oxide- or metal hydroxide-modified cellulosic pulp fibers, such as papermaking fibers, comprising: (a) forming a non-aqueous slurry of the pulp fibers and a non-aqueous solvent, said fiber slurry having a consistency of about 10 weight percent or greater; (b) adding to the slurry an amount of a hydrolyzable organometallic compound of the general formula $M(OR)_x(OR_1)_y$ such that the organometallic compound is absorbed by the fiber walls; (c) optionally removing any organometallic compound not absorbed by the fiber walls by filtration or distillation; and (d) adding water to the fiber to precipitate within the fiber walls a water-insoluble metal oxide of the formula $M_aO_b$ or a water-insoluble metal hydroxide of the formula $M_c(OH)_d$, wherein "M" can be any metal which forms a water-insoluble oxide or hydroxide, "R" and "$R_1$" can be any organic group and can be the same or different, "x" is from 0–4, "y" is from 0–4, x+y>0, and "a", "b", "c" and "d" are each 1 or greater. "$R_1$" can also be any ligand, hereby defined as any organic or inorganic molecule or ion that has at least one electron pair which can be shared with the coordinating metal atom. Included within this definition are classical simple donor ligands which act as electron pair donors to acceptor ions or molecules and the nonclassical or Π-bonding ligands where the metal has d orbitals that can be utilized in bonding and the ligand not only has donor capacity but itself contains molecular orbitals capable of accepting electrons.

In another aspect, the invention resides in modified pulp fibers comprising from about 0.5 to about 60 weight percent of a metal oxide of the formula $M_aO_b$ or a metal hydroxide of the formula $M_c(OH)_d$, wherein "M", "a", "b", "c" and "d" are as defined above.

In another aspect, the invention resides in paper, particularly soft tissue, comprising modified papermaking fibers containing from about 0.5 to about 60 weight percent of a metal oxide of the formula $M_aO_b$ or a metal hydroxide of the formula $M_c(OH)_d$, wherein "M", "a", "b", "c" and "d" are as defined above.

As used herein, "water-insoluble" means having solubility in cold (4° C.) water of less than 0.2 grams per 100 cubic centimeters.

Suitable non-aqueous solvents include but are not limited to isopropyl alcohol, 1-propanol, 1-butanol, acetone, 2-ethylhexanol, methanol and ethanol. Generally polar solvents will be preferred but this again is not a critical aspect of the present invention.

The consistency (percent solids) of the non-aqueous slurry of papermaking fibers 35 is not critical and can be from about 10 to 100 weight percent. Although the organometallic compound can be introduced to the dry papermaking fibers (100 percent consistency), a non-aqueous slurry having a consistency of from about 20 to about 95 weight percent is preferred for improved wetting.

For R and $R_1$, suitable organic groups include, but are not limited to, methyl, ethyl, propyl, butyl, 2-ethylhexyl, isobutyl, isopropyl, hexyl, octyl, octadecyl, dodecyl, pentanedionate and acetylacetonate.

If $R_1$ is a ligand, suitable compounds include, without limitation: substituted carboxylic acids such as methyl salicylate, malic acid, and glycine or dibutyl tartrate as disclosed by U.S. Pat. No. 4,452,969 to McCready herein incorporated by reference;

ortho substituted hydroxyaromatic compounds as disclosed by U.S. Pat. No. 4,452,970 to Brunelle, herein incorporated by reference; and phosphorous compounds such as phosphorous acid, diphenylphosphite, dibutyl phosphite, diisopropyl phosphite and diphenyl decyl phosphite as disclosed by U.S. Pat. No. 5,453,479 to Borman, also herein incorporated by reference.

For routine papermaking, the preferred organometallic compounds are those formed from the metals of groups IIIA and IVA ,with titanium and zirconium being most preferred. Suitable organometallic compounds include, but are not limited to, titanium (IV) isopropoxide, titanium (IV) butoxide, titanium (IV) 2-ethylhexoxide, titanium (IV) ethoxide, titanium (IV) propoxide, titanium diisopropoxide bis(2,4-pentanedionate), zirconium (IV) propoxide, zirconium (IV) ethoxide, zirconium (IV) butoxide, zirconium (IV) isopropoxide (and complex with isopropanol), zirconium (IV) t-butoxide, zirconium (IV) acetylacetonate, yttrium (III) isopropoxide, yttrium (III) ethoxide, yttrium oxide isopropoxide, hafnium(IV) ethoxide, scandium (III) ethoxide, tantalum(V) ethoxide, vanadium (IV) ethoxide, niobium(V) ethoxide, cerium (IV) isopropoxide (and isopropanol complex), barium isopropoxide and copper (II) methoxide.

These organometallic compounds can be added to the papermaking fibers neat or as a solution in a suitable organic solvent. A particularly suitable means of adding the organometallic compounds to the fibers is in the form of a solution of the same non-aqueous solvent used to slurry the papermaking fibers. Such a solution can contain from about 1 to about 100 weight percent of the organometallic compound, more specifically from about 10 to about 100 weight percent, depending on the concentration desired in the final product.

EXAMPLES

Example 1

This example illustrates the method of this invention to form titanium dioxide filled pulp.

46.6 grams (10 grams oven dry basis) of never-dried northern softwood kraft pulp, the water of which was displaced with isopropyl alcohol to a consistency of 21.9%, was placed in a 1 liter flask equipped with a nitrogen purge. 200 milliliters of titanium(IV) isopropoxide (Aldrich, 97%) was introduced into the flask and the slurry allowed to stand for 30 minutes at room temperature. The slurry was then filtered to remove excess titanium(IV) isopropoxide.

The fiber was then returned to the flask and 500 milliliters of distilled water was introduced into the flask. A white precipitate of titanium dioxide formed immediately. The pulp was allowed to sit in the water for 10 minutes before being filtered and washed several times with water to remove excess titanium dioxide. The pulp was then fiberized by beating at high speed in a Waring blender for four minutes until all nits were removed. The pulp was then washed until a clear filtrate was obtained through a 200 mesh screen. The pulp was dried and determined to have a titanium dioxide content of 39.8% as determined by ashing.

2.0 grams of the treated, washed pulp was taken and placed in a kitchen blender with 500 milliliters of water. The sample was then blended on high speed for two minutes. The sample was filtered (a clear filtrate was obtained) and determined to have an ash content of 38.6% as determined by ashing. The 97% ash retention is indicative of the filler being firmly embedded in the cell walls of the fibers.

Example 2

This example demonstrates the use of non-water displaced pulp.

A sample of never- dried eucalyptus pulp was dried at 125° C. for 4 hours to a consistency of 99.5%. 10 grams of the dried pulp was placed in a 250 milliliter flask equipped with a nitrogen purge. 100 milliliters of titanium(IV) isopropoxide was introduced into the flask. Good wetting was noted. The sample was allowed to stand under nitrogen for 60 minutes. The pulp was filtered to remove excess titanium (IV) isopropoxide and returned to the reaction vessel. 100 milliliters of water was then introduced into the flask, at which time the appearance of a white precipitate of titanium dioxide was noted on the fibers. The pulp was allowed to sit in the water for 30 minutes before being filtered and rinsed to remove excess titanium dioxide precipitated on the fibers. The pulp was fiberized in a Waring blender for 4 minutes at high speed until all nits disappeared. The pulp was washed until the filtrate coming through a 200 mesh screen was clear. The pulp was dried and determined to have a titanium dioxide content of 27.8% as determined by ashing.

2.0 grams of the treated, washed pulp was taken and placed in a kitchen blender with 500cc of water. The sample was then blended on high speed for two minutes. The sample was filtered (a clear filtrate was obtained) and determined to have a titanium dioxide content of 23.2% as determined by ashing. The 83% ash retention is indicative of filler being firmly embedded in the cell walls.

Example 3

This example demonstrates the treatment of eucalyptus fibers with an organometallic compound of a metal besides titanium.

36.58 grams (10.24 grams oven dry basis) of never-dried eucalyptus pulp, the water of which was displaced with isopropyl alcohol to a consistency of 28%, was placed in a 0.5 liter flask equipped with a nitrogen purge. 100 milliliters of zirconium(IV) propoxide (Aldrich, 70% in 1-propanol) was introduced into the flask. The fiber slurry was kept under a nitrogen blanket for 30 minutes. The pulp was filtered to remove excess zirconium(IV) propoxide and returned to the reaction vessel. 200 milliliters of water was then introduced into the flask at which time the appearance of a white precipitate of zirconium dioxide was noted on the fibers. The pulp was allowed to sit in the water for 30 minutes before being filtered and rinsed to remove excess zirconium dioxide precipitated on the outside of the fibers. The fibers were washed until the filtrate coming through a 200 mesh screen was clear. The pulp was fiberized in a Waring blender for 4 minutes at high speed until all nits disappeared. The pulp was dried and determined to have a zirconium dioxide content of 44.5% as determined by ashing.

2.0 grams of the treated, washed pulp was taken and placed in a kitchen blender with 500cc of water. The sample was then blended on high speed for two minutes. The sample was filtered (a clear filtrate was obtained) and determined to have a zirconium dioxide content of 43.0% as determined by ashing. The 97% ash retention is indicative of filler being firmly embedded in the cell walls.

Example 4

This example provides, for purposes of comparison in Example 5, a calcium carbonate fiber wall filled pulp as described by U.S. Pat. No. 5,069,539 to Allan et. al.

600 grams of sodium bicarbonate was slowly added to 528 grams of distilled water at room temperature. This solution was then added to never-dried northern softwood kraft pulp (1072 grams at 18.65% consistency) and mixed by hand for 15 minutes. The material was then allowed to stand for 3 hours at 40° C.

The pulp slurry was vacuum filtered to remove excess sodium bicarbonate and the resulting fiber mat was then broken up by hand and placed in a large beaker. 1766 grams of a 50 weight percent calcium chloride solution was prepared by slowly adding 1169 grams of reagent grade $CaCl_2 2H_2O$ to 597 milliliters of water and raising the temperature to 90° C. The hot calcium chloride solution was added all at once to the dewatered fibers and mixed with a spatula. The mixture was then allowed to sit for 45 minutes. The fibers were then rinsed with water until the effluent passing through a 150 mesh screen was clear. The product of the precipitation step was divided into 3 equal parts. Each part was suspended in 3300 milliliters of water so as to obtain an approximately 2% consistency mixture and subjected to high shear mixing at high speed for 4 minutes in a 4L Waring blender. A small aliquot was removed and suspended in 500 milliliters of water in a glass beaker to check for fiber entanglements. After fiberization the material was washed on a 150 mesh screen with a stream of tap water until a clear effluent was obtained. The pulp was dried and determined to have a calcium carbonate content of 35.4% as determined by ashing.

1.5 grams of the treated, washed pulp was taken and placed in a kitchen blender with 500 milliliters of water. The sample was then blended on high speed for two minutes. The sample was filtered (a clear filtrate was obtained) and determined to have a calcium carbonate content of 32.4% as determined by ashing. The 91% ash retention is indicative of filler being firmly embedded in the cell walls.

Example 5

This example describes the preparation of handsheets from the titanium dioxide fiber wall filled pulp.

145 grams of titanium dioxide fiber wall filled pulp made via the procedure of Example 1 and having a consistency of 13.6% (19.57 grams oven dry basis) was mixed with 30.43 grams (oven dry basis) of northern softwood kraft pulp and mixed with 2 liters of water and dispersed in a British Pulp Disintegrator for 5 minutes. A sample of the dispersed furnish was withdrawn, filtered and determined to have a titanium dioxide content of 15.84%. The mixed stock was diluted to a consistency of 0.625% and handsheets were prepared using a British handsheet mold. Different basis weights were obtained by varying the volume of stock added to the handsheet mold. Basis weight, ash content and opacity are given in the table below. Ash content of the handsheets was 15.84%, indicating 100% retention of filler. In a similar manner, control handsheets made with never-dried northern softwood kraft pulp and never-dried northern softwood kraft pulp filled with calcium carbonate and lumen loaded northern softwood kraft are also given in the table.

| Filler | Ash Content | Percent Retention | Basis Weight Filler & Fiber | Fiber Basis Weight | ISO Opacity | Opacity Change |
|---|---|---|---|---|---|---|
| None | 0.30% | N/A | 55 g/m$^2$ | 55 g/m$^2$ | 66.8 | — |
| $TiO_2$ Example 1 | 15.90 | 100 | 55 g/m$^2$ | 46.3 g/m$^2$ | 74.4 | +7.6 |
| $CaCO_3$ Fiber Wall Filled Example 4 | 16.0% | 99% | 55 g/m$^2$ | 46.2 g/m$^2$ | 65.4 | −1.4 |

These results show the high level of filler retention as well as superior opacifying power of the titanium dioxide relative to calcium carbonate which has been precipitated into the cell walls.

It will be appreciated that the foregoing examples, given for purposes of illustration, are not to be construed as limiting the scope of this invention, which is defined by the following claims and all equivalents thereto.

I claim:

1. A method of making metal oxide- or metal hydroxide-modified cellulosic pulp comprising: (a) forming a non-aqueous slurry of cellulosic fibers and a non-aqueous solvent, said fiber slurry having a consistency of about 10 weight percent or greater; (b) adding to the slurry an amount of a hydrolyzable organometallic compound of the general formula $M(OR)_x(OR_1)_y$ such that the organometallic compound is absorbed by the fiber walls; and (c) adding water to the fiber to precipitate within the fiber walls a metal oxide of the formula $M_aO_b$ or a metal hydroxide of the formula $M_c(OH)_d$, wherein "M" can be any metal which forms an insoluble metal oxide or hydroxide, "R" can be any organic group, "$R_1$" can be any organic group or an organic or inorganic coordinating species, "x" is from 0–4, "y" is from 0–4, "x+y" is greater than zero, and "a", "b", "c" and "d" are each 1 or greater.

2. The method of claim 1 where the cellulosic pulp is derived from hardwoods, softwoods, annual plants or combinations thereof.

3. The method of claim 1 further comprising washing the pulp of step (c) to remove excess precipitate located on and outside the cell walls.

4. The method of claim 1 wherein excess organometallic compound not absorbed by the fiber walls in step (b) is removed by filtration prior to step (c).

5. The method of claim 1 where excess organometallic compound not absorbed by the fiber walls in step(b) and excess solvent are removed by distillation prior to step (c).

6. The method of claim 1 where the organometallic compound comprises esters of titanium.

7. The method of claim 1 wherein the organometallic compound is selected from the group consisting of titanium (IV) isoproxide, titanium (IV) butoxide, titanium (IV) 2-ethyl hexoxide, titanium(IV) propoxide and titanium(IV) ethoxide.

8. The method of claim 1 wherein the organometallic compound comprises esters of zirconium.

9. The method of claim 1 where the organometallic compound is selected from the group consisting of zirconium(IV) t-butoxide, zirconium(IV) propoxide, zirconium(IV) Isopropoxide and zirconium(IV) ethoxide.

10. The method of claim 1 wherein a mixture of organometallic compounds is used.

11. The method of claim 10 wherein the mixture comprises an organometallic compound of zirconium and an organometallic compound of titanium.

* * * * *